US011236451B2

(12) United States Patent
Zocco

(10) Patent No.: US 11,236,451 B2
(45) Date of Patent: Feb. 1, 2022

(54) REEL FOR FABRIC MACHINES, FABRIC MACHINE COMPRISING SAID REEL AND METHOD

(71) Applicant: BRAZOLLI S.R.L., Senago (IT)

(72) Inventor: Carmelo Zocco, Saronno (IT)

(73) Assignee: BRAZOLLI S.R.L., Senago (IT)

( * ) Notice: Subject to any disclaimer, the term of this patent is extended or adjusted under 35 U.S.C. 154(b) by 147 days.

(21) Appl. No.: 16/343,392

(22) PCT Filed: Oct. 17, 2017

(86) PCT No.: PCT/IB2017/056446
§ 371 (c)(1),
(2) Date: Apr. 18, 2019

(87) PCT Pub. No.: WO2018/073745
PCT Pub. Date: Apr. 26, 2018

(65) Prior Publication Data

US 2019/0233999 A1 Aug. 1, 2019

(30) Foreign Application Priority Data

Oct. 18, 2016 (IT) ..... 102016000104608

(51) Int. Cl.
*D06B 23/02* (2006.01)
*D06B 3/28* (2006.01)
*B65H 27/00* (2006.01)

(52) U.S. Cl.
CPC ..... *D06B 23/026* (2013.01); *D06B 3/28* (2013.01); *D06B 23/02* (2013.01); *B65H 27/00* (2013.01)

(58) Field of Classification Search
CPC ..... D06B 23/026; D06B 23/02; D06B 3/28; B65H 27/00
USPC ..... 68/212
See application file for complete search history.

(56) References Cited

U.S. PATENT DOCUMENTS 2,796,169 A 6/1957 Smith
4,001,945 A 1/1977 Aurich et al.
4,380,311 A * 4/1983 Torii ..... B65H 27/00 242/615.4

(Continued)

OTHER PUBLICATIONS

International Search Report, dated Nov. 20, 2017 for corresponding International Application No. PCT/IB2017/056446.

(Continued)

*Primary Examiner* — Tinsae B Ayalew
(74) *Attorney, Agent, or Firm* — Intellectual Property Law Group LLP

(57) ABSTRACT

Reel for fabric treating machines, said reel comprising: a substantially cylindrical main body (110) having a side surface (111), a first axial end (112) and a second axial end (113); first and second flanges (114, 115), respectively mounted to the first and second axial ends (112, 113) of said main body (110); at least one drag element (120) mounted, in the operating position, externally to said side surface (111), at least one constraining device (130), associated with said drag element (120) to hold said drag element (120) in said operating position. The constraining device (130) can be switched between a first condition, in which it holds said drag element (120) in said operating position, and a second operating condition, in which it allows said respective drag element (120) to be removed.

17 Claims, 11 Drawing Sheets

(56) References Cited

U.S. PATENT DOCUMENTS

| | | | |
|---|---|---|---|
| 5,307,973 | A | 5/1994 | Schmidt et al. |
| 2016/0272450 | A1 | 9/2016 | Cros et al. |

OTHER PUBLICATIONS

Written Opinion, dated Nov. 20, 2017 for corresponding International Application No. PCT/IB2017/056446.

* cited by examiner

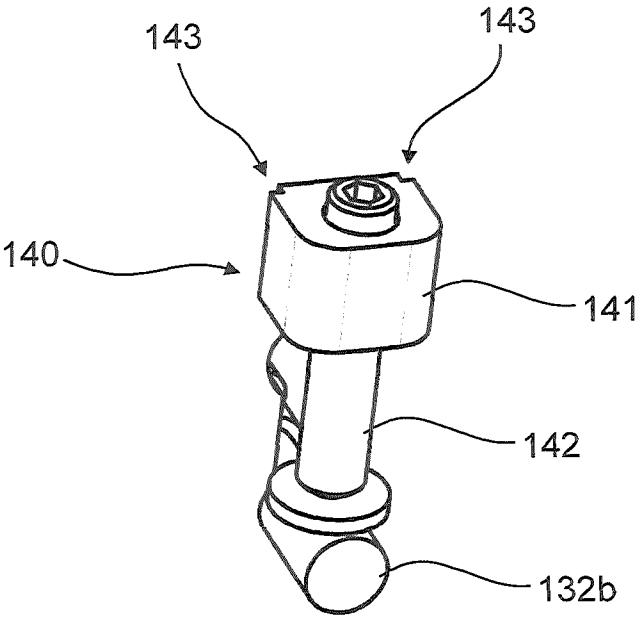
FIG. 20
FIG. 18
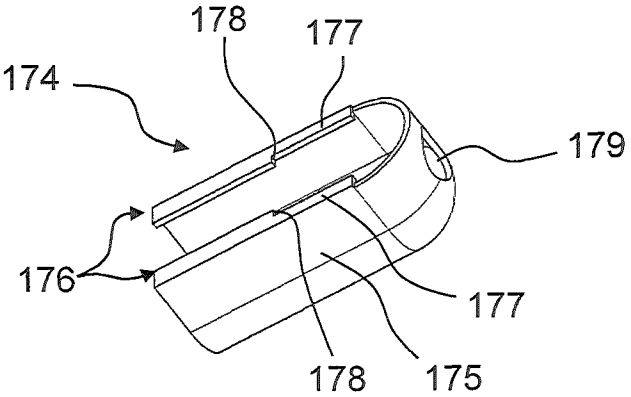
FIG. 19
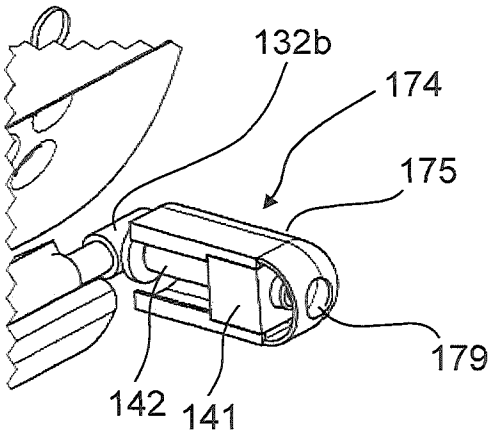

REEL FOR FABRIC MACHINES, FABRIC MACHINE COMPRISING SAID REEL AND METHOD

CROSS-REFERENCE TO RELATED APPLICATIONS

This application is a U.S. National Phase application, under 35 U.S.C. § 371, of International Application no. PCT/1132017/056446, with an international filing date of Oct. 17, 2017, and claims benefit of Italian Application no. 102016000104608 filed on Oct. 18, 2016, each of which are hereby incorporated by reference for all purposes.

BACKGROUND OF THE INVENTION

1. Field of the Invention

The present invention relates to a reel for fabric treating machines.

The present invention further relates to a fabric treating machine, particularly for discontinuous treatment of fabrics in rope form.

More specifically, the machine according to the invention is used for industrial fabric treatment processes and is suitable for different treatments, such as, for example, dyeing, bleaching or washing.

The present invention further relates to a method for removing and replacing a drag element included in said reel.

2. Background

In the fabric treating machines known in the art, the fabric is wound on itself in rope form and then immersed into a treatment bath.

The machines intended for this operation include, therefore, a tank containing the bath of treatment liquid and a plurality of motorized reels, each one rotatable about its own axis of rotation. On each reel a respective fabric in rope form to be treated is laid, which, closed into a loop, runs down from the reel into the bath and then back up on the opposite side of the reel. Each reel is contained in a respective boxed body arranged over the tank and is connected to the tank and supported through a duct that delivers the rope fabric from the reel to the tank and a return duct that guides the fabric from the tank to the reel.

The fabric in rope form is made to circulate by turning the reel and by hitting the fabric itself with a jet of treatment liquid sprayed by suitable nozzles. Each nozzle is arranged in the delivery duct and is connected to the tank. The treatment liquid to be sprayed is taken from the bath and supplied to the nozzles through a recirculation duct which, at an upper portion of the tank, divides into as many branches as the number of ropes to be treated.

For the reel to act properly upon the fabric, suitable drag elements are arranged on the cylindrical side surface of the reel, which are typically made of rubber and extend over the whole axial length of the reel.

Such drag elements generate the necessary friction between the reel and the fabric, so that the latter can be effectively pulled by the turning reel.

According to the state of the art, each drag element is kept constrained to the reel by means of two parallel rods welded to the axial ends of the reel. The drag element is forced (e.g. through the use of a hammer) into the housing delimited by the two rods and the cylindrical side surface of the reel, so that it will stay in position during the operation of the machine.

The drag elements are subject to wear, and therefore need to be periodically replaced, e.g. approx. every two months.

The present Applicant has verified that removing and replacing the drag elements requires complex and difficult operations (which sometimes require dismounting the reel from the machine), resulting in long downtimes.

This translates into decreased productivity of the machine and reduced efficiency of the entire treatment process.

SUMMARY OF THE INVENTION

It is one object of the present invention to provide a reel for fabric treating machines wherein the drag elements can be removed in a quick and simple manner.

It is another object of the present invention to provide a reel for fabric treating machines wherein the drag elements can be removed without the reels having to be dismounted from the machine.

These and other objects are substantially achieved through a reel for fabric treating machines as set out in the appended claims.

BRIEF DESCRIPTION OF THE DRAWINGS

Further features and advantages will become more apparent from the following detailed description of some preferred but non-limiting embodiments of the invention.

This description will refer to the annexed drawings, which are also provided merely as explanatory and non-limiting examples, wherein:

FIGS. 18-20 shows some details of FIG. 17.

DETAILED DESCRIPTION OF THE INVENTION

Figure 1:
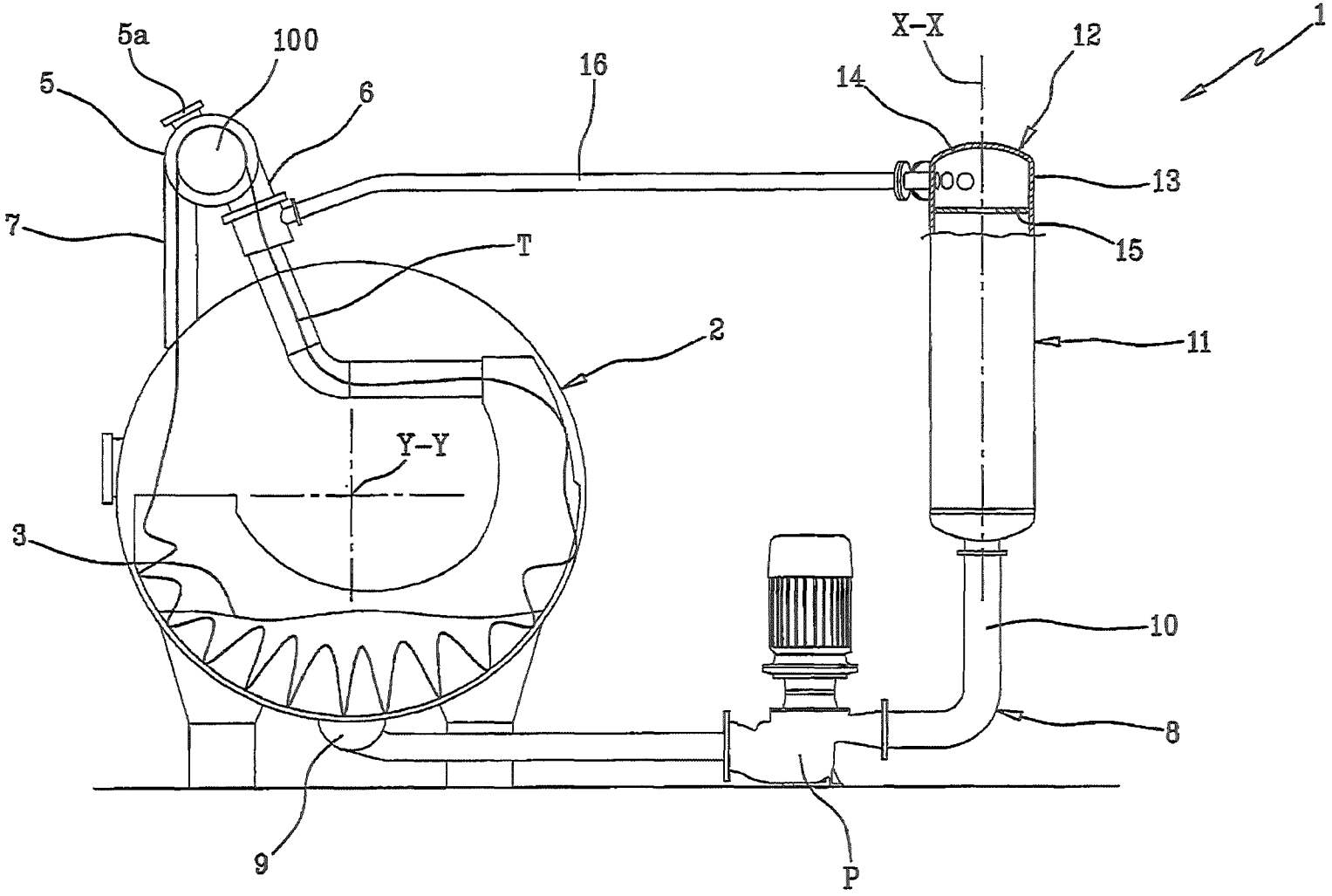
FIG. 1 is a schematic side view of a machine according to the invention.

With reference to the annexed drawings, reference numeral 100 designates as a whole a reel for fabric treating machines in accordance with the present invention.

Reference numeral 1 indicates a fabric treating machine, particularly for discontinuous treatment of fabrics in rope form, wherein the reel 100 can be used.

The machine 1 (FIG. 1) comprises a main tank 2 adapted to contain, in its internally delimited volume, a treatment liquid, which may be, for example, a dye for dyeing the rope fabric T, or a detergent for subjecting the fabric T to a washing cycle. The illustrated tank 2 is a cylinder with a horizontal main axis Y-Y. The liquid creates a bath 3 that occupies the lower part of the main tank 2.

In the upper part of the machine 1, above the tank 2, a plurality of reels 100 are arranged, each one being motorized and rotatable about its own horizontal axis of rotation. Each reel 100 is useful for supporting and guiding a respective rope formed by a fabric T along a closed treatment path within the main tank 2.

Figure 14:
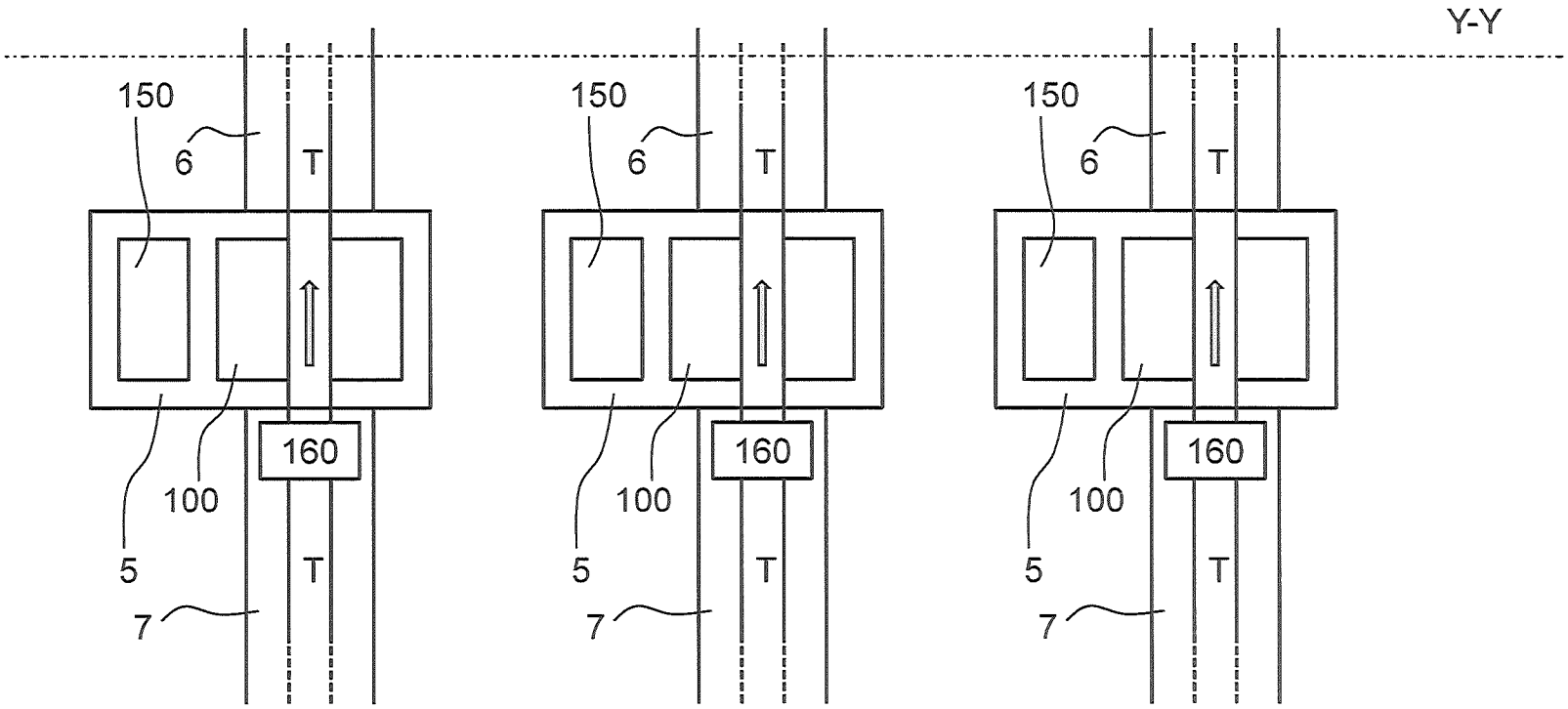
FIG. 14 shows a schematic representation of some parts of the machines illustrated in FIGS. 1-3.

The rotation of each reel 100 is attained by means of a respective drive member 150, as schematized in FIG. 14.

Each reel 100 is arranged inside a boxed container 5 mounted above the tank 2 by means of a first tubular body 6 and a second tubular body 7. The boxed containers 5 are mutually aligned and are arranged along an axis parallel to the main axis Y-Y of the main tank 2.

The above-mentioned tubular bodies 6, 7, in addition to supporting the boxed container 5, put the reel 100 in communication with the inside of the main tank 2. The rope fabric T runs down from the reel 100 into the tank 2 through the first tubular body 6 and then runs back up from the tank 2 to the reel 100 through the second tubular body 7.

Each boxed body 5 has a top opening 5*a*, which is normally closed by a respective closing element. This opening can be used for monitoring and/or maintenance operations.

In the first tubular body 6 at least one distribution member 160 is inserted (as schematized in FIG. 14), e.g. a nozzle, which is oriented at an acute angle relative to the running direction of the rope T, for distributing against the rope fabric T a pressurized jet of treatment liquid taken from the bottom of the main tank 2 through a recirculation duct 8 fitted with a pump P. This nozzle has a two-fold function of wetting the fabric T before immersion and providing the necessary thrust for moving it on towards the bath 3.

The recirculation duct 8 has a first end 9 connected to the bottom of the tank 2 and a second end 10 connected to the bottom of a cylindrical body 11 having a vertical axis, which contains, in a per se known manner, a heat exchanger. The pump P is arranged on the duct 8 between the tank 2 and the cylindrical body 11.

At an upper end of the cylindrical body 11 there is a collector 12 integrated into the cylindrical body 11, and thus having a cylindrical side wall 13 in common with the cylindrical body 11 and a top wall 14 that closes the top end of said cylindrical body 11.

The collector 12 delimits an internal cylindrical volume separated from the exchanger by a septum 15 with at least one passage for the treatment liquid.

The collector 12 has a vertical main axis X-X and is positioned at substantially the same height as the first tubular bodies 6.

From the side wall 13, as many branching pipes 16 extend as the number of the reels 100. Each branching pipe 16 connects the collector 12 to the nozzle located in the tubular body 6.

Figure 2:
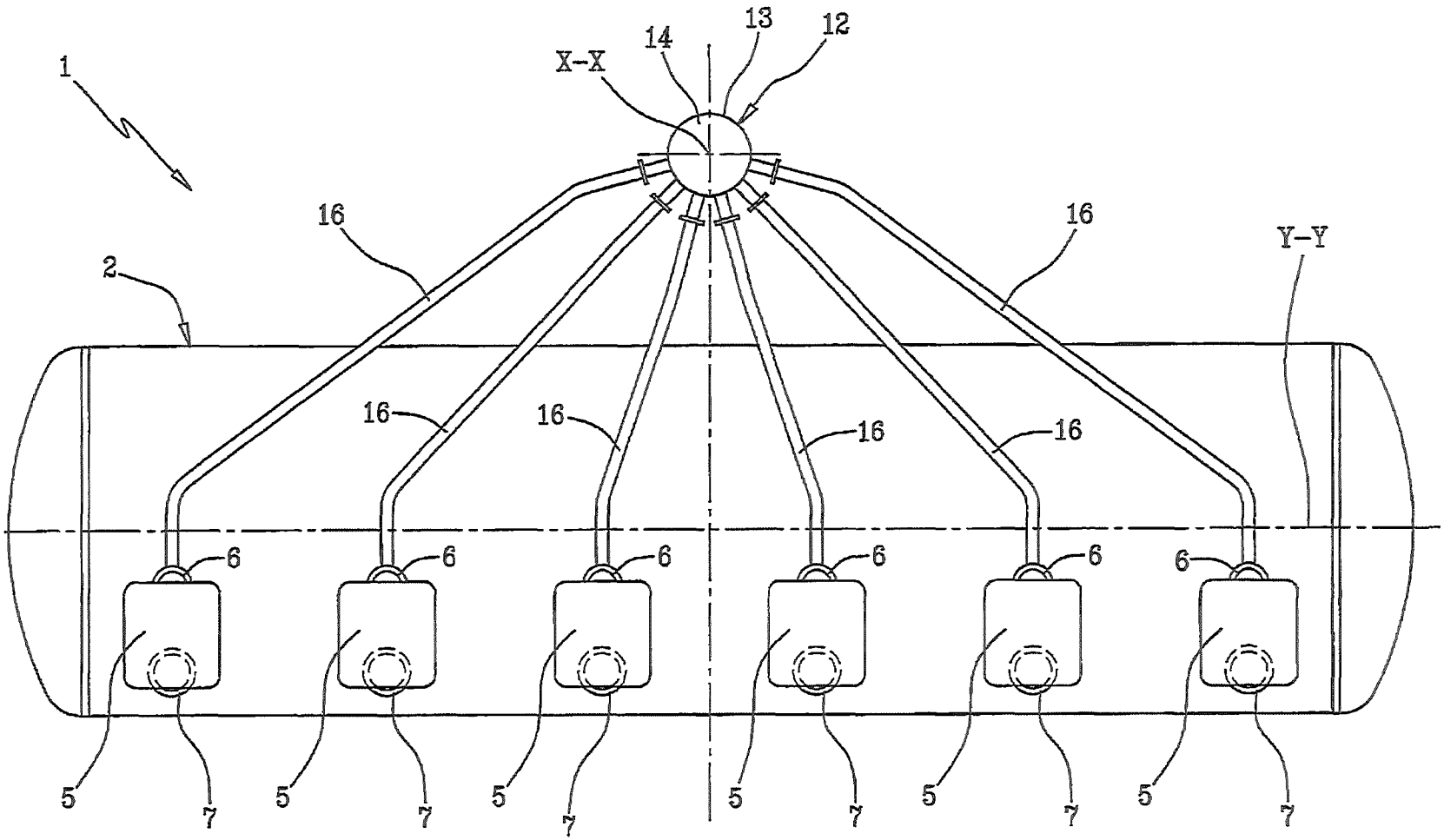
FIG. 2 is a schematic top view of the machine of FIG. 1.

In one embodiment (FIG. 2), the pipes 16 branch off from the collector 12 substantially in a sunburst fashion.

Figure 3:
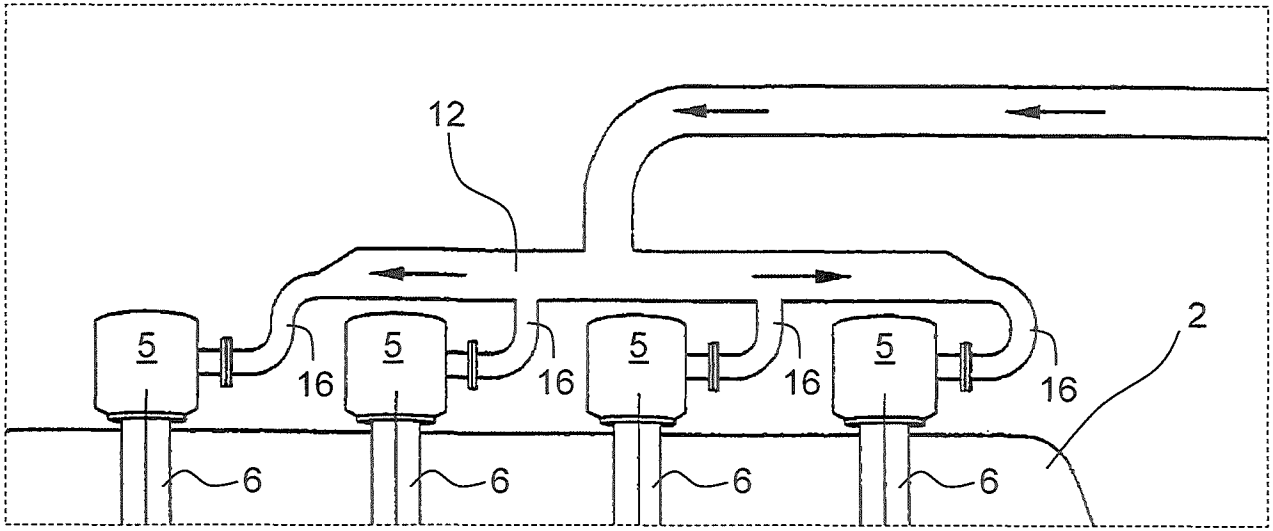
FIG. 3 is a partial front view of a different embodiment of a machine according to the invention.

In one embodiment (schematized in FIG. 3), the pipes 16 branch off from the collector 12 in substantially parallel directions.

The following will describe in detail the structure of one of said reels 100.

Preferably, more than one reel 100 has such a structure; more preferably, all reels of the machine 1 have said structure.

The reel 100 (FIG. 4) comprises, first of all, a substantially cylindrical main body 110 having a side surface 111, a first axial end 112 and a second axial end 113.

The reel 100 further comprises first and second flanges 114, 115, respectively mounted to the first and second axial ends 112, 113 of the main body 110.

The flanges 114, 115 are integral with the main body 110; by way of example, the constraint between the main body 110 and the flanges 114, 115 can be obtained by welding.

Figure 5:
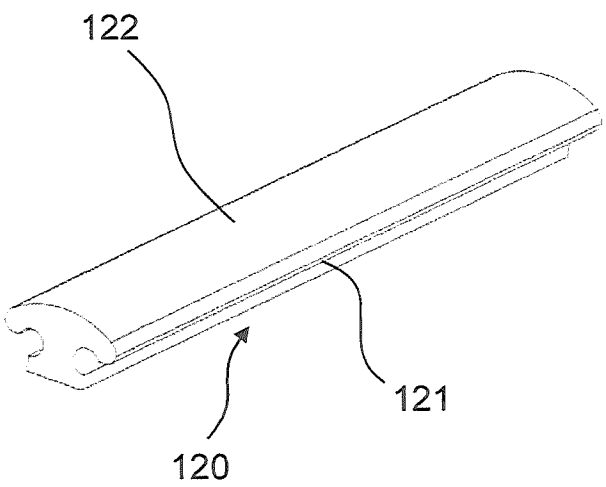
FIG. 5 is a perspective view of an element of the reel of FIG. 4.

The reel 100 further comprises at least one drag element 120 (FIGS. 5, 9) mounted, in the operating position, externally to the side surface 111.

Preferably, the reel 100 is equipped with a plurality of drag elements; by way of example, there may be six drag elements, angularly equidistant along the side surface 111 of the main body 110.

Each drag element is preferably made of elastomeric material, e.g. rubber.

The reel 100 further comprises at least one constraining device 130, associated with the drag element 120 for holding said element 120 in said operating position.

Preferably, all of the drag elements that are present on the reel 100 are associated with one constraining device having the same structural and functional characteristics as the constraining device 130 that will be described below.

Preferably each drag element is associated to a respective constraining device 130, capable of operating in a way substantially independent from the other constraining devices. In accordance with the invention, the constraining device 130 can be switched between a first condition, in which it holds the drag element 120 in the operating position, and a second condition, in which it allows the drag element 120 to be removed.

Preferably, when the constraining element 130 associated with a determined drag element 120 is switched in its second condition, and allows removal of said determined drag element 120, the constraining devices associated with other drag elements remain in their first condition, thereby maintaining the respective drag elements in operating position.

In other terms, the constraining devices which are present on the reel 100, preferably operate in a substantially independent way from each other.

In this way, it is possible to avoid that, when a determined drag element has to be removed, also the other drag elements are released from the reel, thereby for example falling in the main tank 2 of the machine 1.

Figure 10:
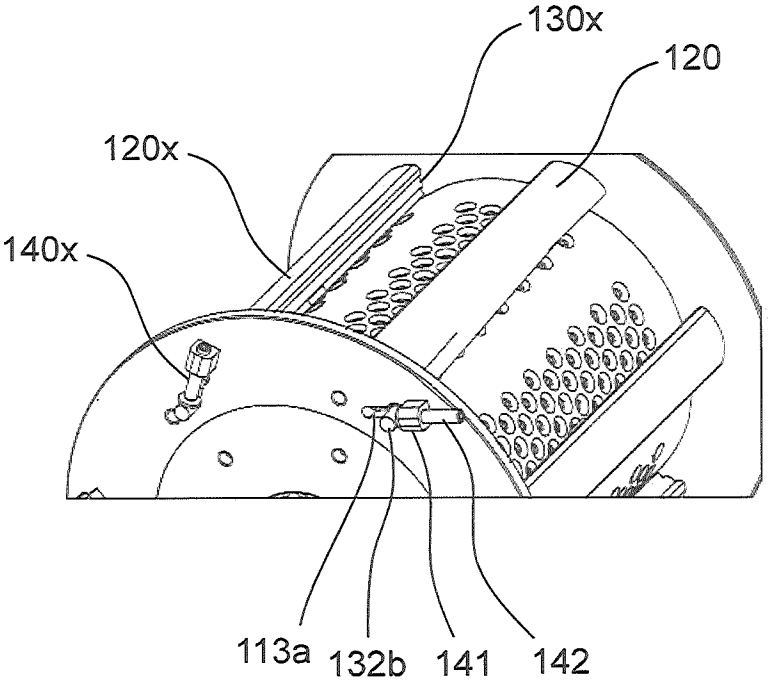
FIGS. 9-13 represent some steps of the method according to the invention.

By way of example, FIG. 10 shows the drag element 120, a generic further drag element 120*x* and a further constraining device 130*x* associated to the latter. When the constraining device 130 associated with the drag element 120 is switched in the second condition, the further constraining device 130*x* remains is its first condition, thereby maintaining the further drag element 120*x* in operating position.

Preferably, the constraining device 130 defines a housing 130*a* in which the drag element 120 is at least partially inserted.

When the constraining device 130 is in the first condition, the housing 130*a* has a certain width; when the constraining device 130 is in the second condition, the housing 130*a* is wider.

Thus, the drag element 120 can be removed and replaced quickly without requiring much operator effort.

More in detail, the constraining device 130 may comprise a first rod 131 and a second rod 132.

The first rod 131 and the second rod 132 are mounted on the main body 110 and define the housing 130*a*.

In brief, the housing 130*a* is the spatial region comprised between the first rod 131, the second rod 132 and the corresponding underlying portion of the side surface 111 of the main body 110.

Preferably, when the constraining device 130 is in the first condition, the first rod 131 has a different arrangement relative to the second rod 132 than when the constraining device 130 is in the second condition.

In other words, the first and second conditions of the constraining device 130 correspond to different mutual positions of the first and second rods 131, 132.

In one embodiment, the first rod 131 is substantially integral with the main body 110.

Preferably, the first rod 131 is substantially parallel to the longitudinal axis of the main body 110.

Preferably, the first rod 131 has a first end 131*a* secured to the first flange 114 and a second end 131*b* secured to the second flange 115.

By way of example, the ends 131*a*, 131*b* may be welded to the first flange 114 and to the second flange 115, respectively.

As an alternative, the first rod 131 may be constrained in such a way that it can rotate about its own longitudinal axis, without however being able to make any other movement relative to the main body 110.

In one embodiment, the second rod 132 is movable relative to the main body 110.

Figure 7:
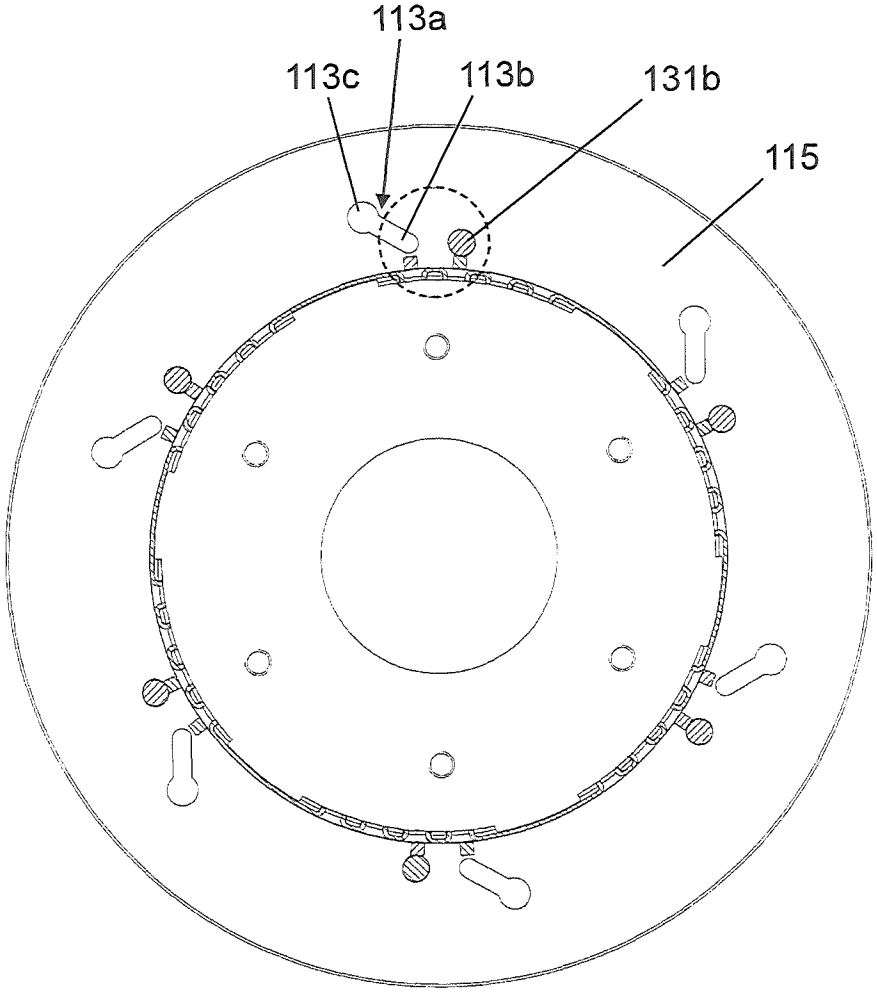
FIG. 7 is a side view of the reel of FIG. 4, wherein some parts have been removed in order to highlight other parts.

Preferably, the second rod 132 (FIGS. 4, 15) has a first end 132*a* constrained to the first flange 114, and a second end 132*b* which is movable in a slot 113*a* formed in the second flange 115 (FIG. 7).

The slot 113*a* may have a first portion 113*b* with a substantially rectangular profile, and a second portion 113*c* with a substantially circular profile. The second portion 113*c* constitutes an extension of the first portion 113*b*.

In general, the slot 113*a* is so shaped and sized as to allow the second end 132*b* of the second rod 132 to be moved between a first position, in which it defines the first condition of the constraining device 130, and a second position, in which it defines the second condition of the constraining device 130.

Figure 15:
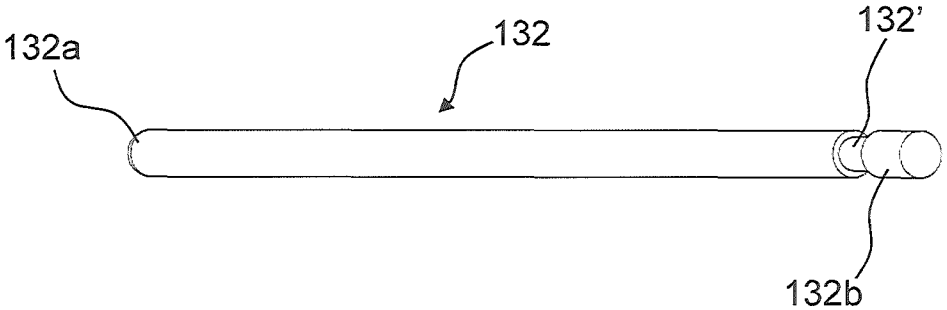
FIG. 15 shows a component of the reel of FIG. 4.

As shown in FIG. 15, the second rod 132 may have a groove 132' at the second end 132*b*, adapted to be engaged with the profile of the slot 113*a*.

The coupling between the groove 132' and the profile of the slot 113*a* substantially prevents any movement of the second rod 132 in the axial direction.

Preferably, the first end 132*a* of the second rod 132 is simply inserted in a respective hole in the first flange 114, without any further constraint. This allows the second rod 132 to be moved between the first and second positions of its second end 132*b*.

Preferably, when the second end 132*b* is in the first position, the second rod 132 is parallel to the longitudinal axis of the main body 110.

Preferably, when the second end 132*b* is in the second position, the second rod 132 is transversal (as opposed to parallel) to the longitudinal axis of the main body 110.

Note that the cross-section of the first and second rods 131, 132 is preferably substantially circular. Other configurations may however be conceived, provided that a housing can be formed which is suitable for engaging with the drag element 120.

Preferably, the reel 100 further comprises a fastening member 140.

The fastening member 140 acts upon the constraining device 130 to hold the constraining device 130 in its first condition.

In practice, the fastening member 140 causes the constraining device 130 to firmly hold the drag element 120 in the operating position, particularly when the machine 1 is in use.

More in detail, the fastening member 140 can be switched between an operating condition, in which it holds the constraining device 130 in the first condition, and an idle condition, in which it allows the constraining device 130 to be moved into the second position.

Preferably, the fastening member 140 acts upon the second end 132*b* of the second rod 132 to hold said second end 132*b* in the first position.

Figure 4:
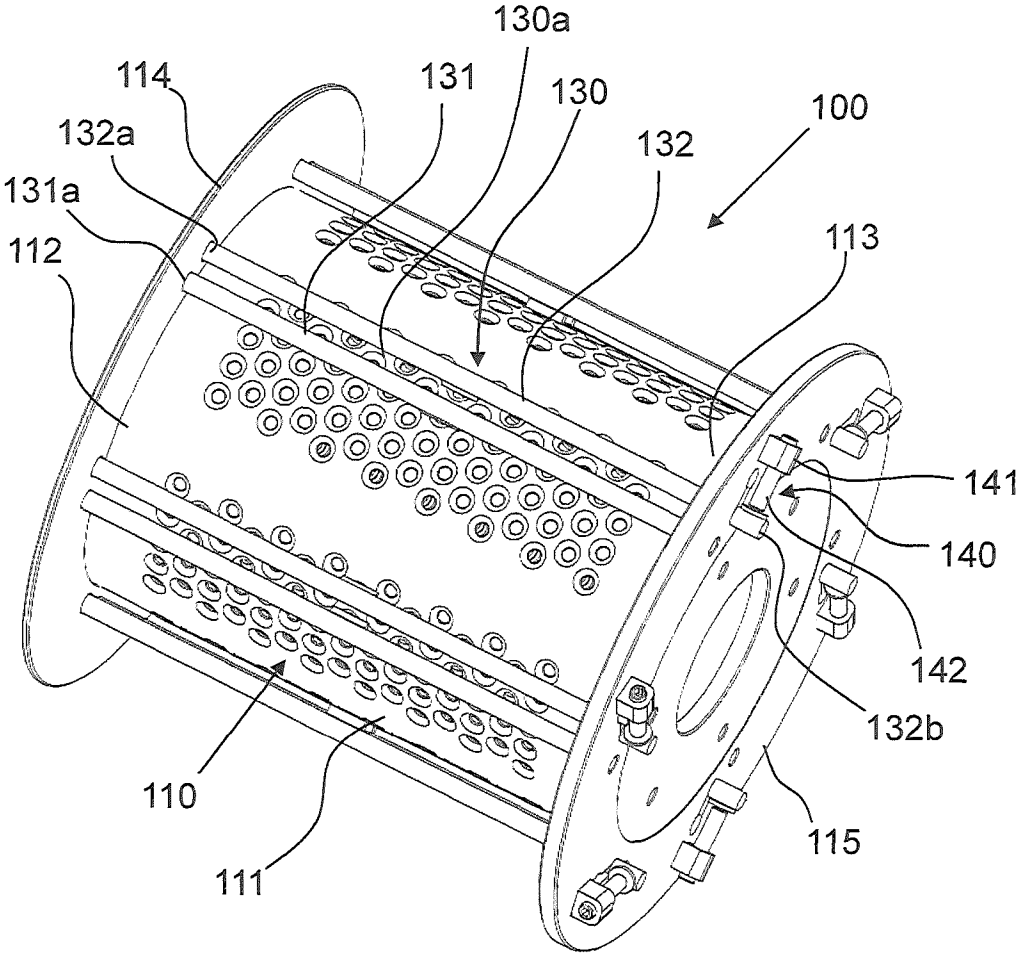
FIG. 4 is a perspective view of a reel according to the invention.
Figure 8:
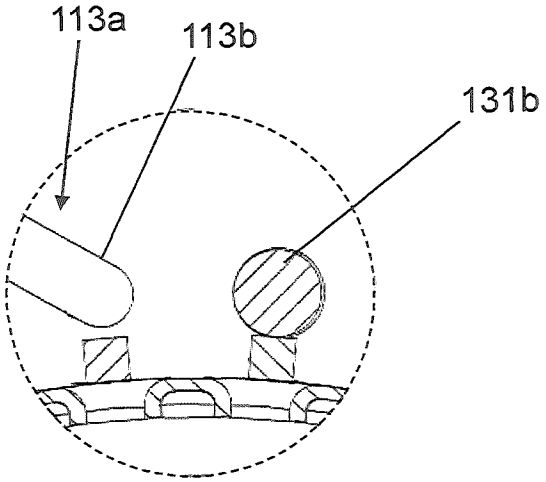
FIG. 8 shows a detail of FIG. 7.
Figure 9:
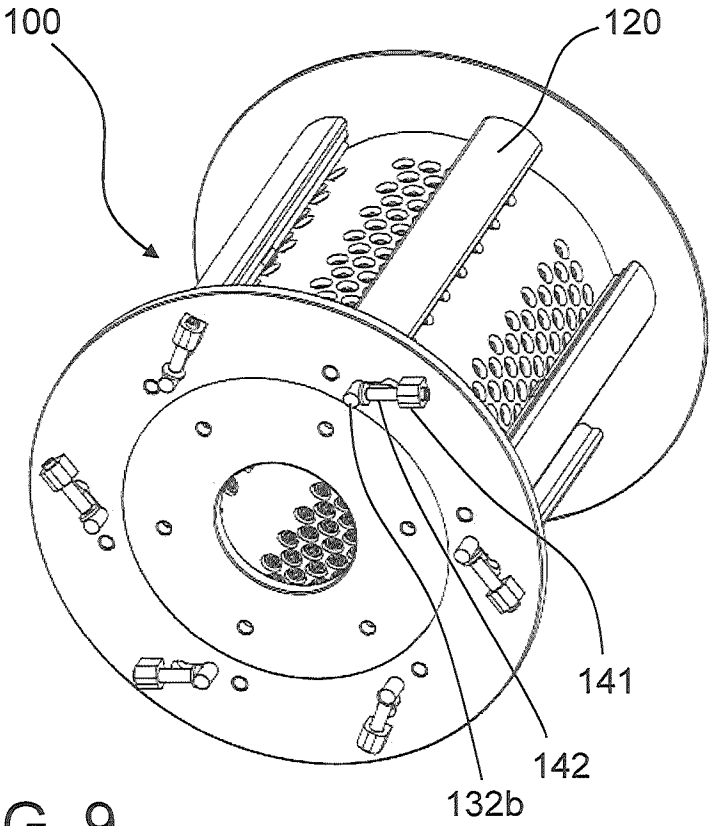

With reference to FIGS. 4 and 9, it can be noticed that the fastening member 140, when it is in the operating condition, pushes the second end 132*b* of the second rod 132 against the profile of the slot 113*a*, in particular against the end of the first portion 113*b* of the slot 113*a* that is closest to the second end 131*b* of the first rod 131.

Preferably, the fastening member 140 comprises a support element 141 secured to the second flange 115 and an active element 142 supported by the support element 141. The active element 142 is movable relative to the support element 141.

The support element 141 can be made in the form of a small block, e.g. substantially parallelepiped in shape, having a threaded through hole.

The active element 142 can be made in the form of an at least partially threaded pin, adapted to be coupled to the through hole in the support element 141.

By means of a per se known tool, the active element 142 is screwed in order to act upon the second end 132*b* of the second rod 132 and push and hold the same in its first position; the active element 142 can then be unscrewed to substantially release the second end 132*b* of the second rod 132, thus allowing the same to be brought, e.g. manually, into the second position, so as to loosen the constraint on the drag element 120 and allow it to be removed.

Preferably, the active element 142 can be made in such a way that it cannot be removed from the support element 141 (e.g. captive screw). In other words, the active element 142 can be unscrewed up to some sort of end-of-travel element and/or up to a condition in which any additional unscrewing action will no longer produce any axial movement of the active element 142, so that, in particular, it will not come out of the support element 141.

This will make the process of removing/replacing the drag element 120 even faster, since the operator will not have to pay special attention to the fact that the active element 142 might disengage from the support element 141 (e.g. because fully unscrewed from the threaded seat) and then fall into the boxed body 5 and/or the main tank 2.

It has to be noted that, as said, the reel 100 preferably comprises a plurality of drag elements 120, each associated to a respective constraining device 130. Advantageously, each constraining element 130 is associated with a respective fastening member, preferably having structure and working substantially identical to the fastening member 140 disclosed hereabove. By way of example, FIG. 10 shows fastening member 140*x* associated to the further drag element 120 and to the further constraining device 130.

In an embodiment, each fastening member is further provided with a covering structure that is analogous to the covering structure 170 that will be disclosed in the following.

Figure 6:
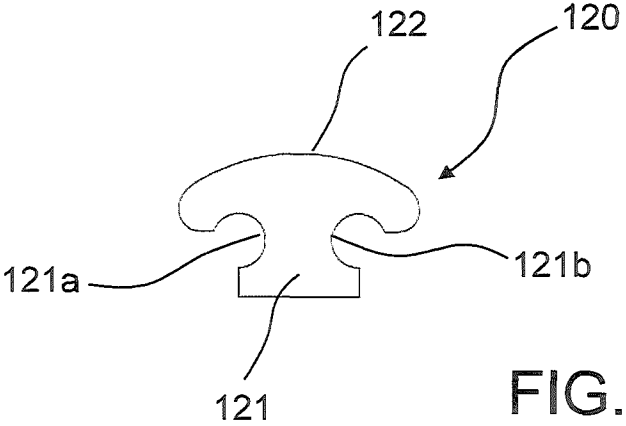
FIG. 6 is a cross-sectional view of the element of FIG. 5.

The drag element 120 (FIGS. 5, 6, 9) preferably has an elongated shape, extending from the first axial end 112 to the second axial end 113 of the main body 110.

Preferably, the drag element 120 has an operating portion 122 adapted to act upon fabrics to be subjected to the treatment. In particular, the operating portion 122, due to the friction generated with the fabric wound around the main body 110, drags the fabric and promotes the forward movement thereof along the treatment path.

Preferably, the drag element 120 also has an engagement portion 121 adapted to be constrained to the constraining device 130.

In particular, the engagement portion 121 may have a pair of grooves 121*a*, 121*b* with mutually facing convexity. Such grooves 121*a*, 121*b* allow the engagement portion 122 to be coupled by interference with the housing 131.

In one embodiment, a covering structure 170 is included for the fastening member 140. The covering structure 170 may cover one or more fastening members 140. It is thus possible to prevent the fabric from catching on the fastening members 140.

Figure 16:
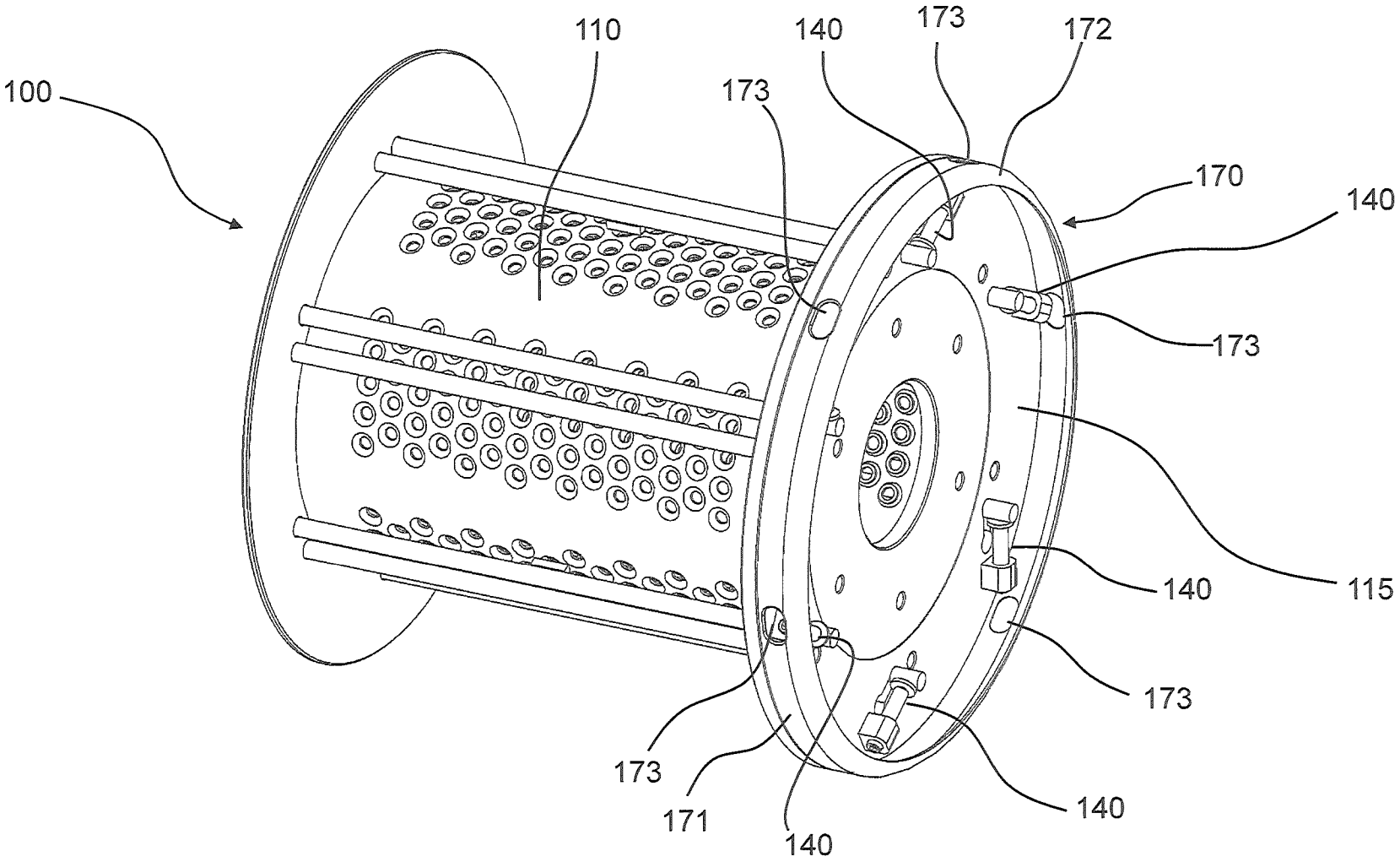
FIG. 16 shows a first embodiment of an element of the reel of FIG. 4.

In one embodiment (FIG. 16), the covering structure 170 has a substantially cylindrical conformation, substantially concentric to the main body 110. Preferably, the covering structure 170 extends along the circumferential edge of the second flange 115. Preferably, the covering structure 170 has a first portion 171, substantially parallel to the axis of rotation of the reel 100, and a second portion 172, contiguous to the first portion 171 and inclined relative to the latter. Preferably, on the covering structure 170, in particular on the first portion thereof 171, a plurality of apertures 173 are formed, each one located near a respective fastening member 140. Through the apertures 173 it is possible to gain access to the active element 142 and operate it in order to lock/unlock the second end 132*b* of the second rod 132.

Figure 17:
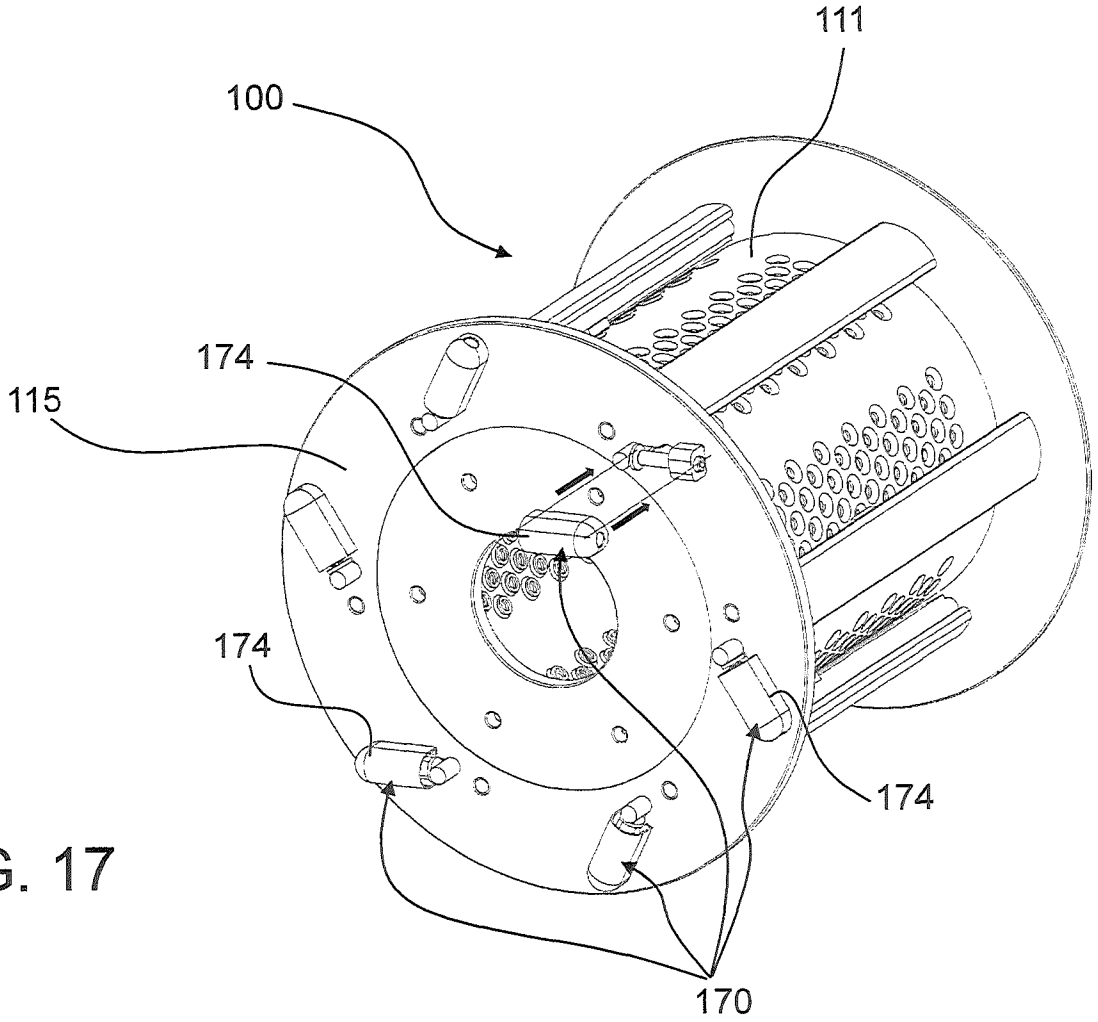
FIG. 17 shows a second embodiment of the element of FIG. 16.

In one embodiment (FIG. 17), the covering structure 170 comprises a plurality of covering elements 174. Preferably, each covering element 174 is associated with a respective fastening member 140.

Each covering element 174 (FIGS. 18-20) has a protecting portion 175 and a constraining portion 176. The protecting portion 175 has a convex shape, so as to prevent the fabric from getting caught up. The constraining portion 176 allows the covering element to be constrained to the respective fastening member 140 in a "captive" manner, i.e. by means of a positive and reliable constraint, so that the covering element 174 cannot fall inside the boxed body 5 and/or the main tank 2. In particular, the constraining portion 176 has a pair of lips 177 which, via a snap coupling with the respective seats 143 of the fastening member 140, prevent the covering element 174 from moving away from the fastening member 140 in a direction substantially parallel to the axis of rotation of the reel 100. A pair of undercuts 178, which delimit the lips 177, prevent any movement of the covering element 174 in directions parallel to the second flange 115.

Preferably, the covering element 174 has a through hole 179 that allows access to the active element 142 (e.g. for screwing/unscrewing it) without requiring removal of the covering element 174.

The covering element 174 can be made from any material suitable for this purpose, e.g. thin sheet metal.

When the drag element 120 needs to be removed, the following steps are carried out.

First of all, the reel 100 is turned in order to bring the drag element 120 under the opening 5*a* of the boxed body 5, so that the operator can act upon the drag element 120 without removing the reel 100 from the machine 1.

Subsequently the fastening member 140 is moved from its current operating condition (FIG. 9) to the idle condition (FIG. 10). For this purpose, the active element 142 is unscrewed to release the second end 132*b* of the second rod 132.

The second end 132*b* of the second rod 132 can then be moved from the first position to the second position, thus switching the constraining device 130 from the first condition to the second condition.

As aforesaid, in the second condition the housing 130*a* is wider than when the constraining device 130 is in the first condition.

Figure 12:
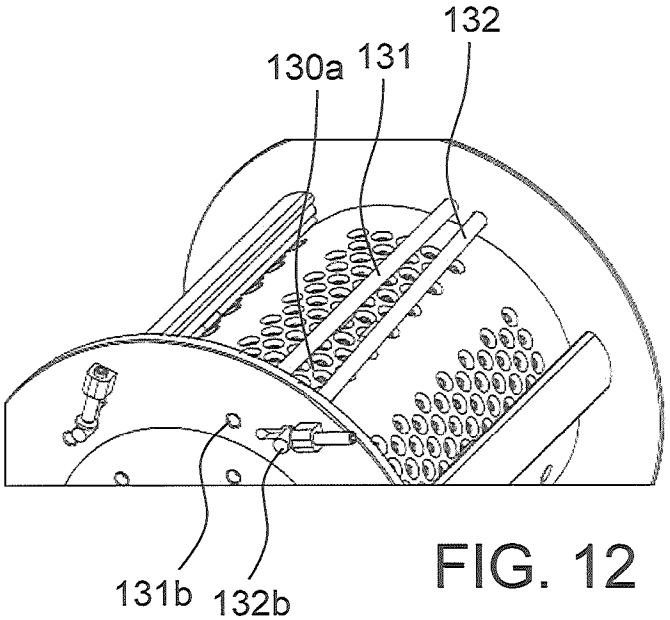
Figure 11:
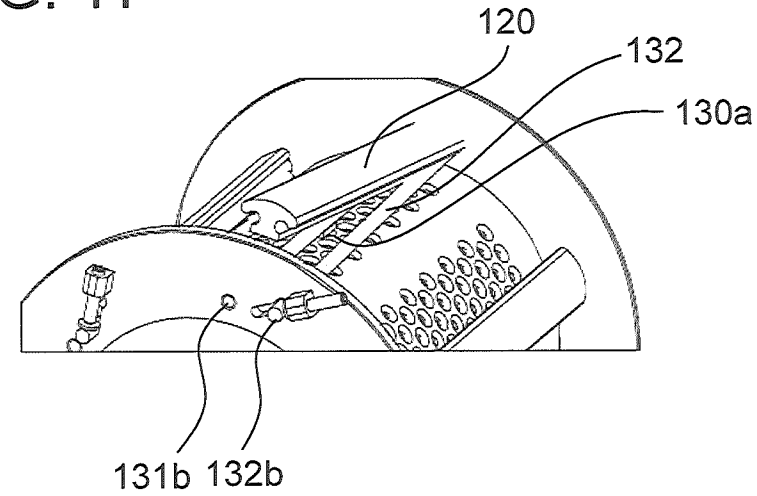

The drag element 120 can thus be removed in a simple and quick manner (FIGS. 11, 12).

Figure 13:
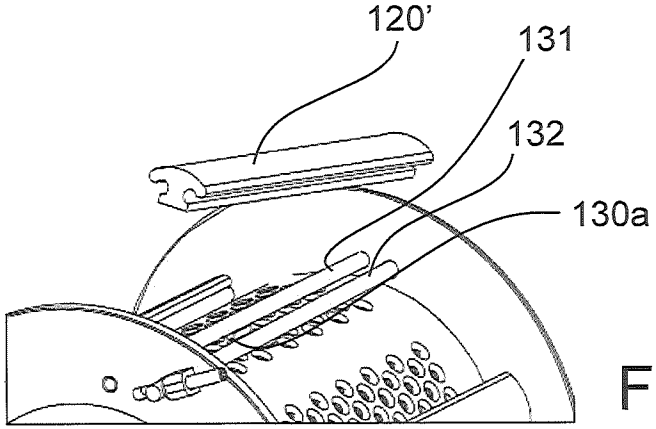

A new drag element 120', wholly similar to the drag element 120, is then prepared (FIG. 13). Unlike the drag element 120, which is supposed to be worn out, the new drag element 120' is new or at least in a better condition.

The new drag element 120' is inserted into the housing 130*a* defined by the constraining device 130. Note that at this point of the process the constraining device is still in the second condition. The new drag element 120' can therefore be inserted in a simple and quick manner. In order to facilitate the insertion, a friction-reducing substance, such as water and soap, may be associated beforehand with the new drag element 120'.

Once the new drag element 120' has been positioned, the constraining device 130 is switched from the second condition to the first condition, so as to maintain a firm constraint on the new drag element 120'.

For this purpose, one preferably screws the active element 142 of the fastening member 140 that acts upon the second end 132*b* of the second rod 132, pushing it until the latter reaches its first position. In this way, the housing 130*a* will have again the same size as it had at the beginning (before starting the step of removing the drag element 120); the new drag element 120' will thus be held firmly in position due to the coupling thereof with the rods 131, 132.

The invention offers significant advantages.

First of all, the invention allows the drag elements of a reel to be removed in a simple and fast manner, leading to considerable time savings in the course of the treatment process.

Furthermore, the drag elements can also be removed and replaced without dismounting the reel from the machine; in this case as well, the complexity of the task and the time necessary for carrying it out are reduced.

The invention claimed is:

1. A reel for fabric treating machines, said reel comprising:

a) a substantially cylindrical main body (110) having a side surface (111), a first axial end (112) and a second axial end (113);

b) first and second flanges (114, 115), respectively mounted to the first and second axial ends (112, 113) of said main body (110);

c) at least one drag element (120) adapted to drag a fabric (T) to be treated, said at least one drag element (120) being mounted, in an operating position, externally to said side surface (111), d) at least one constraining device (130), associated with said drag element (120) to keep said drag element (120) in said operating position, wherein said constraining device (130) can be switched between a first condition, in which it holds said drag element (120) in said operating position, and a second condition, in which it allows said drag element (120) to be removed; and wherein said constraining device (130) defines a housing (130*a*) in which said drag element (120) is at least partially inserted, wherein when said constraining device (130) is in the first condition said housing (130*a*) is narrower than when said constraining device (130) is in the second condition.

2. The reel according to claim 1, wherein said constraining device (130) comprises a first rod (131) and a second rod (132), said first rod (131) and second rod (132) being mounted on said main body (110) and defining said housing (130*a*).

3. The reel according to claim 2, wherein when said constraining device (130) is in the first condition said first rod (131) has a different arrangement relative to said second rod (132) than when said constraining device (130) is in the second condition.

4. The reel according to claim 3, wherein said first rod (131) is integral with said main body (110), said second rod (132) being movable relative to said main body (110).

5. The reel according to claim 4, wherein said first rod (131) has a first end (131*a*) secured to said first flange (114) and a second end (131*b*) secured to said second flange (115).

6. The reel according to claim 4, wherein said second rod (132) has a first end (132*a*) constrained to said first flange (114) and a second end (132*b*) which is movable in a slot (113*a*) formed in said second flange (115).

7. The reel according to claim 6, wherein said slot (113*a*) is so shaped and sized as to allow the second end (132*b*) of said second rod (132) to be moved between a first position, in which it defines the first condition of said constraining device (130), and a second position, in which it defines the second condition of said constraining device (130).

8. The reel according to claim 1, further comprising a fastening member (140) acting upon said constraining device (130) to hold the constraining device in the first condition.

9. The reel according to claim 8, wherein said fastening member (140) can be switched between an operating condition, in which it holds said constraining device (130) in the first condition, and an idle condition, in which it allows said constraining device (130) to be moved into the second position.

10. The reel according to claim 9, wherein said constraining device (130) comprises a first rod (131) and a second rod (132), and wherein said fastening member (140) acts, at least when it is in the operating condition, upon a second end (132*b*) of said second rod (132) to hold the second end (132*b*) of said second rod (132) in the first position.

11. The reel according to claim 1, further comprising a fastening member (140) acting upon said constraining device (130), wherein said fastening member (140) comprises a support element (141) secured to said second flange (115) and an active element (142) supported by said support element (141) and movable relative to said support element (141).

12. The reel according to claim 11, wherein the active element (142) is so designed that it cannot be released from the support element (141).

13. A reel for fabric treating machines, said reel comprising:

a) a substantially cylindrical main body (110) having a side surface (111), a first axial end (112) and a second axial end (113);

b) first and second flanges (114, 115), respectively mounted to the first and second axial ends (112, 113) of said main body (110);

c) at least one drag element (120) adapted to drag a fabric (T) to be treated, said at least one drag element (120) being mounted, in an operating position, externally to said surface (111), d) at least one constraining device (130), associated with said drag element (120) to keep said drag element (120) in said operating position, wherein said constraining device (130) can be switched between a first condition, in which it holds said drag element (120) in said operating position, and a second condition, in which it allows said drag element (120) to be removed; and a covering structure (170) associated with the main body (110), in particular with the second flange (115), said covering structure (170) being adapted to cover one or more fastening members (140) and to prevent the fabric (T) from catching on said one or more fastening members (140).

14. The reel according to claim 1, wherein said drag element (120) has an elongated shape, extending from the first axial end (112) to the second axial end (113) of said main body (110).

15. A reel for fabric treating machines, said reel comprising:

a) a substantially cylindrical main body (110) having a side surface (111), a first axial end (112) and a second axial end (113);

b) first and second flanges (114, 115), respectively mounted to the first and second axial ends (112, 113) of said main body (110);

c) at least one drag element (120) adapted to drag a fabric (T) to be treated, said at least one drag element (120) being mounted, in an operating position, externally to said side surface (111), d) at least one constraining device (130), associated with said drag element (120) to keep said drag element (120) in said operating position, wherein said constraining device (130) can be switched between a first condition, in which it holds said drag element (120) in said operating position, and a second condition, in which it allows said drag element (120) to be removed; and wherein said drag element (120) has an engagement portion (121), which is adapted to be constrained to the constraining device (130), and an operating portion (122), which is adapted to work on fabrics to be treated.

16. The reel according to claim 15, wherein the engagement portion (121) of said drag element (120) has a pair of grooves (121*a*, 121*b*) with mutually facing convexity, which allow said engagement portion (121) to be coupled by interference to a housing (130*a*) defined by the constraining device (130).

17. The reel according to claim 1, further comprising at least one further drag element (120*x*), associated with a respective further constraining device (130*x*), wherein, when said constraining device (130) is switched in the respective second condition, allowing the removal of said drag element (120), said further constraining device (130*x*) remains in its first condition, maintaining said further drag element (120*x*) in its operating position.

* * * * *